US005503127A

United States Patent [19]

Djordjevic

[11] Patent Number: 5,503,127

[45] Date of Patent: Apr. 2, 1996

[54] FUEL INJECTION PUMP WITH AUXILIARY CONTROL SYSTEM

[75] Inventor: Ilija Djordjevic, East Granby, Conn.

[73] Assignee: Stanadyne Automotive Corp., Windsor, Conn.

[21] Appl. No.: 355,067

[22] Filed: Dec. 13, 1994

[51] Int. Cl.[6] ..... F02M 37/04

[52] U.S. Cl. ..... 123/450; 417/462; 123/457

[58] Field of Search ..... 123/450, 460, 123/462, 457; 417/462

[56] References Cited

U.S. PATENT DOCUMENTS

| | | | |
|---|---|---|---|
| 2,746,442 | 5/1956 | Roosa . | |
| 2,876,756 | 3/1959 | Gold et al. . | |
| 2,902,016 | 9/1959 | Powell et al. . | |
| 3,930,484 | 1/1976 | Skinner | 123/450 |
| 3,986,487 | 10/1976 | Yanai . | |
| 4,014,305 | 3/1977 | Skinner et al. . | |
| 4,132,205 | 1/1979 | Merritt . | |
| 4,201,170 | 5/1980 | Overfield | 123/450 |
| 4,406,264 | 9/1983 | Mowbray . | |
| 4,430,974 | 2/1984 | Bofinger et al. . | |
| 4,442,816 | 4/1984 | Haberland . | |
| 4,475,513 | 10/1984 | Flaig et al. . | |
| 4,574,759 | 3/1986 | LeBlanc | 123/450 |
| 4,598,683 | 7/1986 | Ohmori et al. . | |
| 4,733,640 | 3/1988 | Laufer et al. . | |
| 4,901,082 | 2/1990 | LeBlanc | 123/450 |
| 5,012,785 | 5/1991 | Long | 123/450 |
| 5,180,290 | 1/1993 | Green . | |
| 5,197,441 | 3/1993 | Green . | |

FOREIGN PATENT DOCUMENTS

| | | | |
|---|---|---|---|
| 1313496 | 4/1973 | United Kingdom | 123/450 |
| 2178112 | 2/1987 | United Kingdom | 123/450 |

*Primary Examiner*—Carl S. Miller
*Attorney, Agent, or Firm*—Chilton, Alix & Van Kirk

[57] ABSTRACT

A fuel injection pump having an inlet metering valve for supplying a metered quantity of fuel from a transfer pump to a pumping chamber and an auxiliary control system for limiting the maximum quantity of fuel supplied to the pumping chamber via the inlet metering valve. An auxiliary valve piston is axially shiftable by the transfer pump outlet pressure to provide a variable restriction between the transfer pump and metering valve for establishing a maximum fuel quantity limit within a predetermined speed range of the pump. A low-speed fuel passage is provided in parallel with the variable restriction for establishing a maximum fuel quantity limit within a lower speed range. The back pressure chambers of the auxiliary valve piston, a transfer pressure regulator piston and a pump timing piston are connected to a pump housing cavity to equalize the back pressures in those chambers at the same constant pressure maintained by a housing pressure regulator.

16 Claims, 4 Drawing Sheets

FUEL INJECTION PUMP WITH AUXILIARY CONTROL SYSTEM

The present invention generally relates to fuel injection pumps of the type having a pumping chamber, one or more pumping plungers, means for reciprocating the pumping plunger(s) for delivering high pressure charges of fuel from the pumping chamber to an internal combustion engine for fuel injection, a transfer pump for supplying fuel at a regulated outlet pressure which increases with pump speed and an inlet metering valve mounted between the transfer pump and pumping chamber and mechanically or electrically operated for supplying a metered quantity of fuel to the pumping chamber. More particularly, the present invention (a) relates to a fuel injection pump of the type described having a new and improved auxiliary control system for performing one or more control functions of the pump in relation to the regulated outlet pressure of the transfer pump and (b) also relates to a fuel injection pump of the type described having a new and improved auxiliary control system for limiting, during certain engine operating conditions, the maximum quantity of fuel supplied to the pumping chamber via the inlet metering valve.

In fuel injection pumps of conventional design of the type described, the inlet metering valve regulates the quantity of fuel supplied to the pumping chamber in relation to the operation of the inlet metering valve and the regulated outlet pressure of the transfer pump. In such pumps, it is important to regulate the transfer pump outlet pressure in precise relationship to pump speed so that the quantity of fuel supplied to the pumping chamber is regulated in precise relationship to pump speed and also so that the regulated outlet pressure can be used by auxiliary control systems of the pump to perform certain functions of the pump in precise relationship to pump speed.

Also, in some fuel injection pumps of conventional design of the type described, a rotary inlet metering valve is angularly positioned to regulate the quantity of fuel supplied to the pumping chamber up to an upper quantity limit established by the maximum stroke of the pumping plunger(s) or established at a lower level during certain operating conditions of the pump by a torque piston which limits rotation of the inlet metering valve in its opening direction. In such pumps, it is frequently desirable to lower the upper fuel quantity limit, typically during a certain intermediate speed range of the engine, to improve engine performance, reduce engine emissions and/or avoid engine smoking.

A principal object of the present invention is to provide in a fuel injection pump of the type described, a new and improved auxiliary control system which performs a control function of the pump in relationship to the regulated outlet pressure of the transfer pump and in precise relationship to pump speed.

Another object of the present invention is to provide in a fuel injection pump of the type described, a new and improved auxiliary control system for limiting the maximum quantity of fuel supplied to the pumping chamber via the inlet metering valve during an intermediate speed range of the engine.

Another object of the present invention is to provide in a fuel injection pump of the type described, a new and improved auxiliary control system for lowering the upper fuel quantity limit below the upper limit established by the other fuel quantity limiting mechanism(s) of the pump. Included in this object is the provision of an auxiliary control system which establishes an upper fuel quantity limit within a certain speed range of the engine.

A further object of the present invention is to provide in a fuel injection pump of the type described, a new and improved auxiliary control system which limits the maximum quantity of fuel supplied to the pumping chamber within a certain speed range which can be modified by adjustment or simple modification of the auxiliary control system.

A still further object of the present invention is to provide a new and improved auxiliary control system having one or more of the previously described functions and benefits, which is of simple construction, which can be readily embodied in fuel injection pumps of conventional design, which will not adversely affect the normal operation of the pump, and which will operate consistently and reliably over a long service free life.

Other objects in part will be obvious from the following description and in part will be pointed out in more detail hereinafter.

A better understanding of the present invention will be obtained from the following detailed description and accompanying drawings.

DESCRIPTION OF PREFERRED EMBODIMENTS

Figure 1:
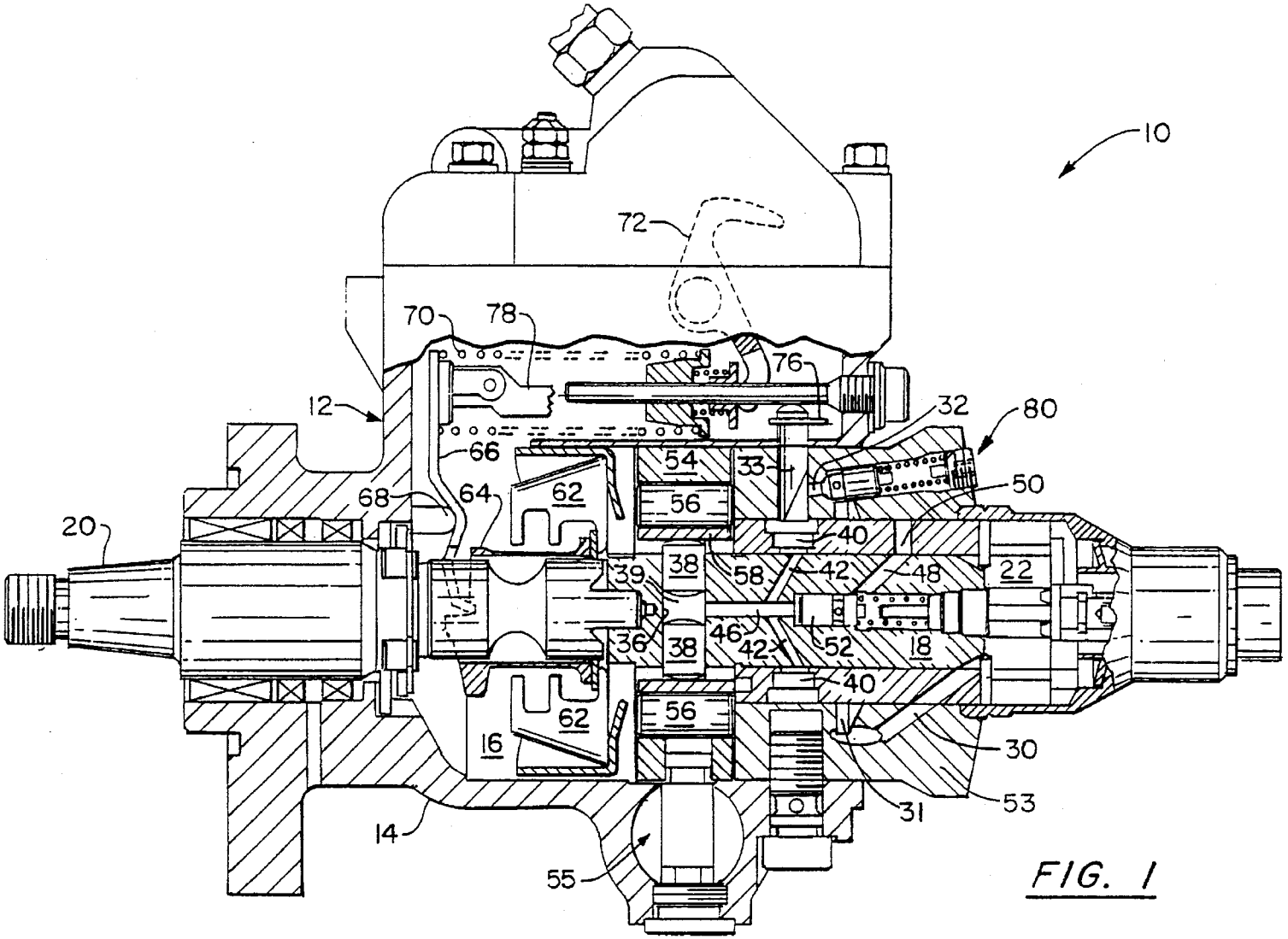
FIG. 1 is a longitudinal section view, partly broken away and partly in section, of a fuel injection pump having an auxiliary control system incorporating a first embodiment of the present invention.
Figure 2:
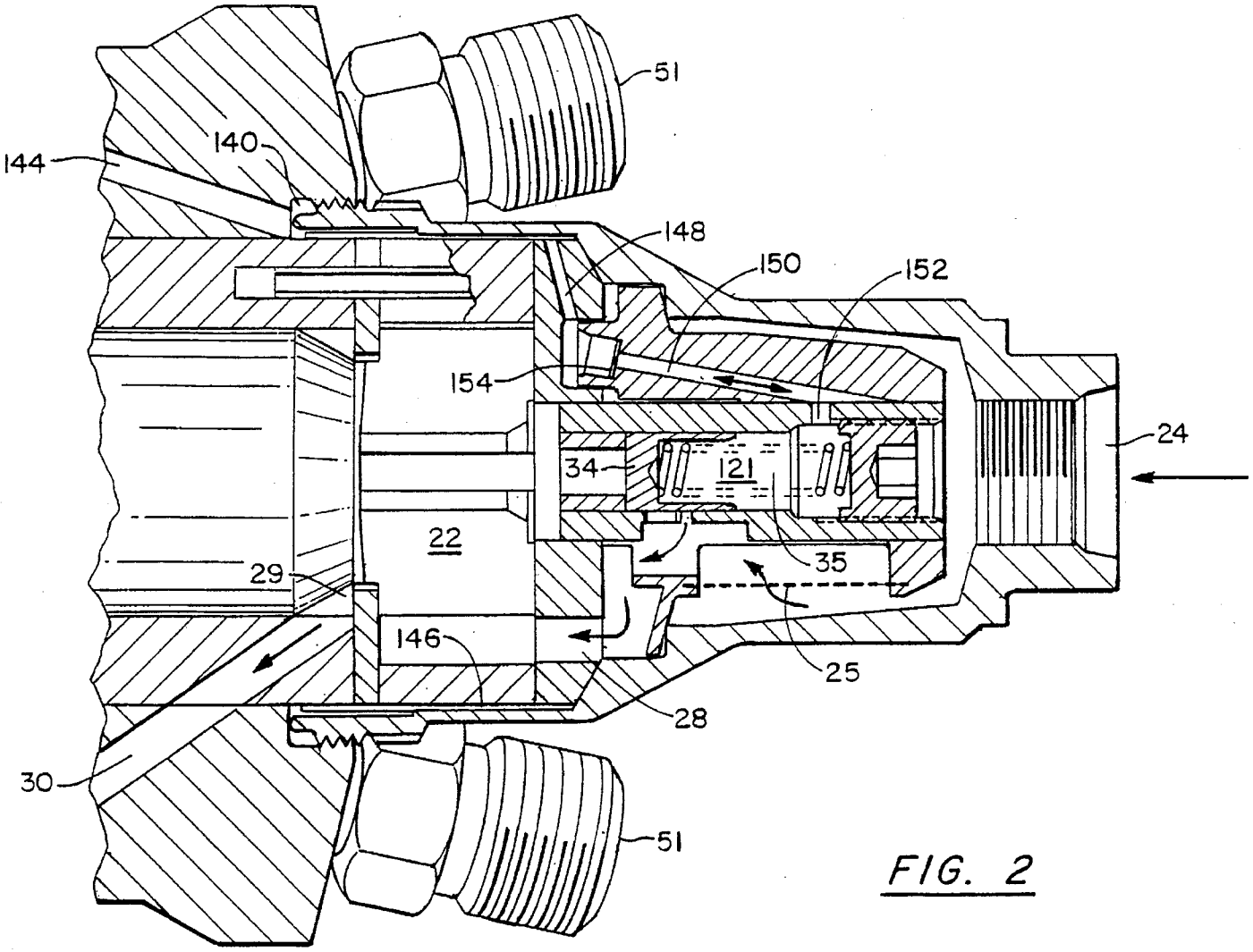
FIG. 2 is an enlarged, partial, longitudinal section view, partly broken away and partly in section, of the fuel injection pump, showing an outer end portion of the pump.
Figure 3:
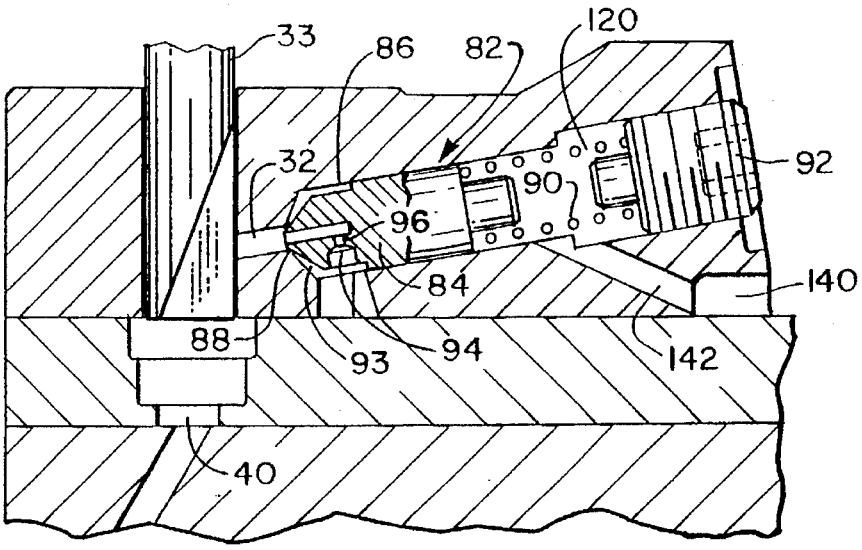
FIG. 3 is an enlarged, partial, longitudinal section view, partly broken away and partly in section, of the fuel injection pump, showing a valve of the auxiliary control system.

Referring now to the drawings in detail wherein the same numerals represent the same or similar parts, an exemplary fuel injection pump 10 having an auxiliary control system 80 incorporating a first embodiment of the present invention is shown in FIGS. 1–3. The pump 10 has a housing 12 with a governor chamber 16. A rotor 18 and rotor drive shaft 20 are coaxially mounted in a body 14 of the housing 12. The pump 10 is adapted to be mounted on an internal combustion engine (not shown) to drive the shaft 20 and rotor 18 with the engine, normally at one-half engine speed.

A vane-type transfer pump 22 is provided at the outer end of the rotor 18. A feed pump 26 (FIG. 4) supplies fuel from a tank 23 (FIG. 4) via a line filter 27 (FIG. 4), a housing inlet 24 and an internal screen filter 25 to a transfer pump inlet 28. A transfer pump outlet annulus 29 (FIGS. 1 and 2) is connected via an inclined passage 30 and annulus 31 to an inclined inlet bore 32 of a rotary inlet metering valve 33. A regulator piston 34 of a transfer pump regulator 35 regulates the outlet pressure of the transfer pump 22 by returning excess fuel to the transfer pump inlet 28. The regulator piston 34 operates in a conventional manner (except as hereinafter described) so that the regulated outlet or transfer pressure increases with pump speed (e.g., increases from 40 psi at idle speed to 110 psi at maximum speed) to meet the increased fuel requirements of the engine and to provide a speed related pressure for performing certain control functions of the pump 10, including operating certain auxiliary mechanisms of the pump 10, in relation to pump speed.

The pump rotor 18 has one or more diametral bores 36, each receiving a pair of opposed pumping plungers 38. A pumping chamber 39 formed by the bore(s) 36 is supplied fuel via the inlet metering valve 33, a plurality of radial inlet ports 40 (two of which are shown in FIG. 1) and a pair of diagonal inlet passages 42 in the rotor 18. Fuel is delivered from the pumping chamber 39 at high pressure through an axial bore 46 and inclined distributor bore 48 in the rotor 18 to a plurality of distributor outlet ports 50 (one of which is shown in FIG. 1). The outlet ports 50 are connected to fuel injection nozzles (not shown) of the engine through fittings 51 angularly spaced around a hydraulic head 53. A delivery valve 52 is mounted in the axial bore 46 to provide a sharp cut-off of fuel to the nozzles and a residual pressure in the downstream fuel lines (not shown) leading to the nozzles.

An annular cam ring 54 having an internal cam surface actuates the pumping plungers 38 inwardly together as the rotor 18 rotates for delivering charges of fuel from the pumping chamber 39 at high pressure. A pair of roller assemblies, each comprising a roller 56 and roller shoe 58, are mounted in radial alignment with the plungers 38 for actuating the plungers 38 inwardly with the cam ring 54. The cam ring 54 is angularly adjusted by a timing piston 55 for varying the delivery timing of the high pressure charges of fuel.

The inlet ports 40 are located around the rotor 18 to register with the diagonal inlet passages 42 during the outward intake strokes of the plungers 38 as the rotor 18 rotates. Similarly, the outlet ports 50 are located to register with the distributor passage 48 during the inward compression strokes of the plungers 38 as the rotor 18 rotates.

A plurality of governor weights 62, angularly spaced around the drive shaft 20, bias, via a sleeve 64, a governor plate 66 in one pivotal direction about a support pivot 68. The governor plate 66 is urged in the opposite pivotal direction by a governor spring assembly 70, the bias of which is adjustable by a throttle operated cam 72. The governor plate 66 is connected to angularly position the inlet metering valve 33 by an arm 76 fixed to the metering valve 33 and a link and spring mechanism 78 (only partly shown) interconnecting the governor plate 66 and arm 76.

As is well known, a metered quantity of fuel is supplied to the pumping chamber 39 during each intake stroke of the plungers 38. The fuel quantity is regulated by the inlet metering valve 33 by varying the metering valve restriction to the passage of fuel from the transfer pump 22 to the pumping chamber 39. The governor rotates the metering valve 33 in a closing direction to increase the fuel restriction if the pump speed increases above an equilibrium speed established by the opposing forces of the governor weights 62 and governor spring assembly 70. Similarly, the governor rotates the metering valve 33 in an opening direction to reduce the fuel restriction if the speed falls below the equilibrium speed.

The maximum quantity of fuel supplied to the pumping chamber 39 is limited by the maximum stroke of the pumping plungers 38. A leaf spring or other mechanism (not shown) may be provided in a conventional manner for limiting the maximum plunger stroke. In addition, the pump may employ a suitable torque limiting mechanism (not shown) having a torque piston for lowering the upper fuel quantity limit (by limiting rotation of the metering valve 33 in the opening direction) within a certain speed range of the pump.

In accordance with the present invention, the auxiliary control system 80 establishes an upper or maximum fuel quantity limit during certain engine operating conditions. During such conditions, the auxiliary control system 80 establishes an upper fuel quantity limit below the upper limit established by the maximum plunger stroke and, if the pump has a torque limiting mechanism which is effective during such conditions, below the upper limit established by that mechanism.

The auxiliary control system 80 comprises an auxiliary valve 82 with a valve piston 84 mounted in an enlarged valve bore section 86 of the metering valve inlet bore 32. The valve piston 84 serves as an axially shiftable needle valve member and has an inner frustoconical end face engageable with a conical valve seat 88. The needle valve 84 is biased inwardly to a closed position in engagement with the valve seat 88 by a compression spring 90 and is biased outwardly against the closure spring 90 by transfer pressure. When the needle valve 84 is closed, the effective transverse area of the needle valve 84 acted on by the upstream transfer pressure is less than (approximately 90% of) the total transverse area of the needle valve 84. The remaining transverse area of the needle valve 84 (i.e., the central inner end portion of the needle valve 84) is acted on by the downstream pressure at the metering valve inlet. That downstream pressure will vary, not only with the transfer pump outlet pressure, but also with the needle valve opening and the angular position of the inlet metering valve 33.

The initial bias of the closure spring 90 is adjustable with a set screw 92 to establish the transfer pressure, and therefore the pump speed and engine speed, at which the needle valve 84 is initially lifted from its seat 88. When the needle valve 84 is displaced from its seat, the needle valve 84 and valve seat 88 define a primary flow passage 93 in series with and between the transfer pump 22 and inlet metering valve 33. The axial displacement of the needle valve 84 and the size of the variable restriction established by the needle valve 84 are primarily a function of transfer pressure and therefore increase with pump speed. As hereinafter described, the primary flow passage 93 serves as a fuel control passage for limiting the quantity of fuel supplied to the pumping chamber 39 during a certain speed range of the engine. Above that speed range, the primary flow passage 93 does not restrict the flow of fuel to the pumping chamber 39.

A low-speed bypass passage 94 is provided in parallel with the primary passage 93 by radial and axial bores in the needle valve 84. At low speed, when the needle valve 84 is closed, the bypass passage 94 provides the only passage between the transfer pump 22 and metering valve 33. The bypass passage 94 has an orifice or restriction 96 which is sized so that during engine cranking and at low speed when the outward intake movement of the plungers is relatively slow and the fuel intake interval is relatively long, the bypass passage 94 does not restrict or limit the supply of fuel to the pumping chamber 39. At a certain low threshold speed (e.g., engine speed of 600 RPM), the bypass passage 94 establishes an upper fuel quantity limit below the upper limit established by the maximum stroke of the pumping plungers 38. As the speed increases, the upper limit established by the bypass passage 94 decreases due to the increasing speed of the plungers 38 and the decreasing fuel intake interval. The upper limit established by the maximum stroke of the pumping plungers is shown by line A in FIG. 5. The upper limit established by the low-speed bypass passage 94 is shown by line B in FIG. 5.

Figure 5:
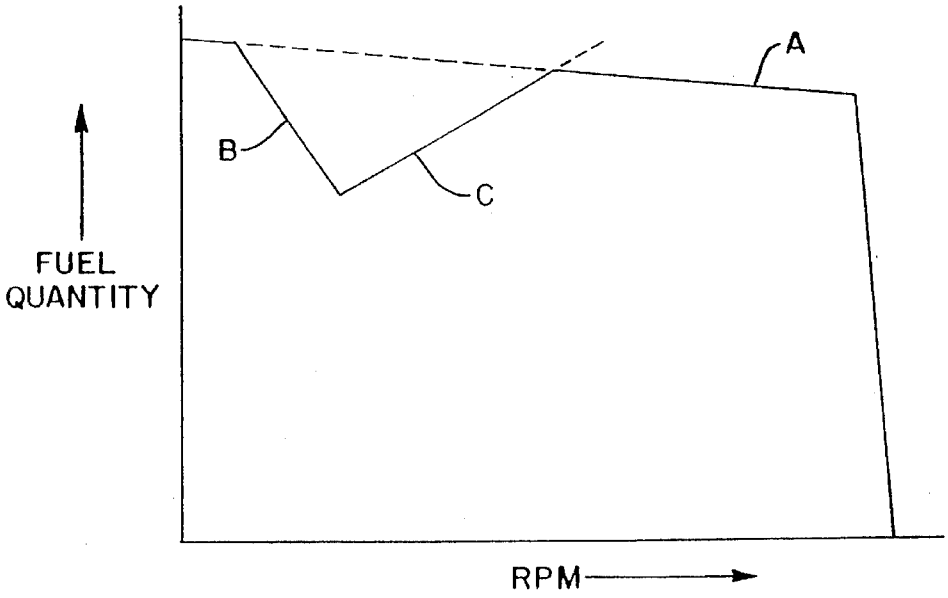
FIG. 5 is a graph showing the relationship between the speed and upper fuel quantity limit of the fuel injection pump.

When the pump reaches a certain intermediate threshold speed (e.g., corresponding to an engine speed of 1000 RPM) determined primarily by the initial bias of the closure spring 90, the needle valve 84 is lifted from its valve seat 88 by the transfer pressure to open the primary flow passage 93. As the speed increases, the needle valve displacement increases and the needle valve restriction decreases. The upper fuel quantity limit established by the combination of the primary passage 93 and bypass passage 94 therefore increases. At a third higher speed (e.g., engine speed of 1400 RPM), that upper fuel quantity limit equals the upper limit established by the maximum stroke of the plungers 38. Line C in FIG. 5 shows the upper fuel quantity limit established by the auxiliary metering system 80 after the needle valve 84 is lifted from its seat 88.

Thus, the auxiliary control system 80 serves as an auxiliary metering system for lowering the upper fuel quantity limit during a certain speed range of the engine. During the lower part of that speed range, the upper limit is determined by the size of the low-speed orifice 96. During the upper part of that speed range, the upper limit is determined by the initial bias and spring rate of the closure spring 90. The size of the low-speed orifice 96 and the initial bias and spring rate of the closure spring 90 are selected accordingly for each pump application.

Figure 4:
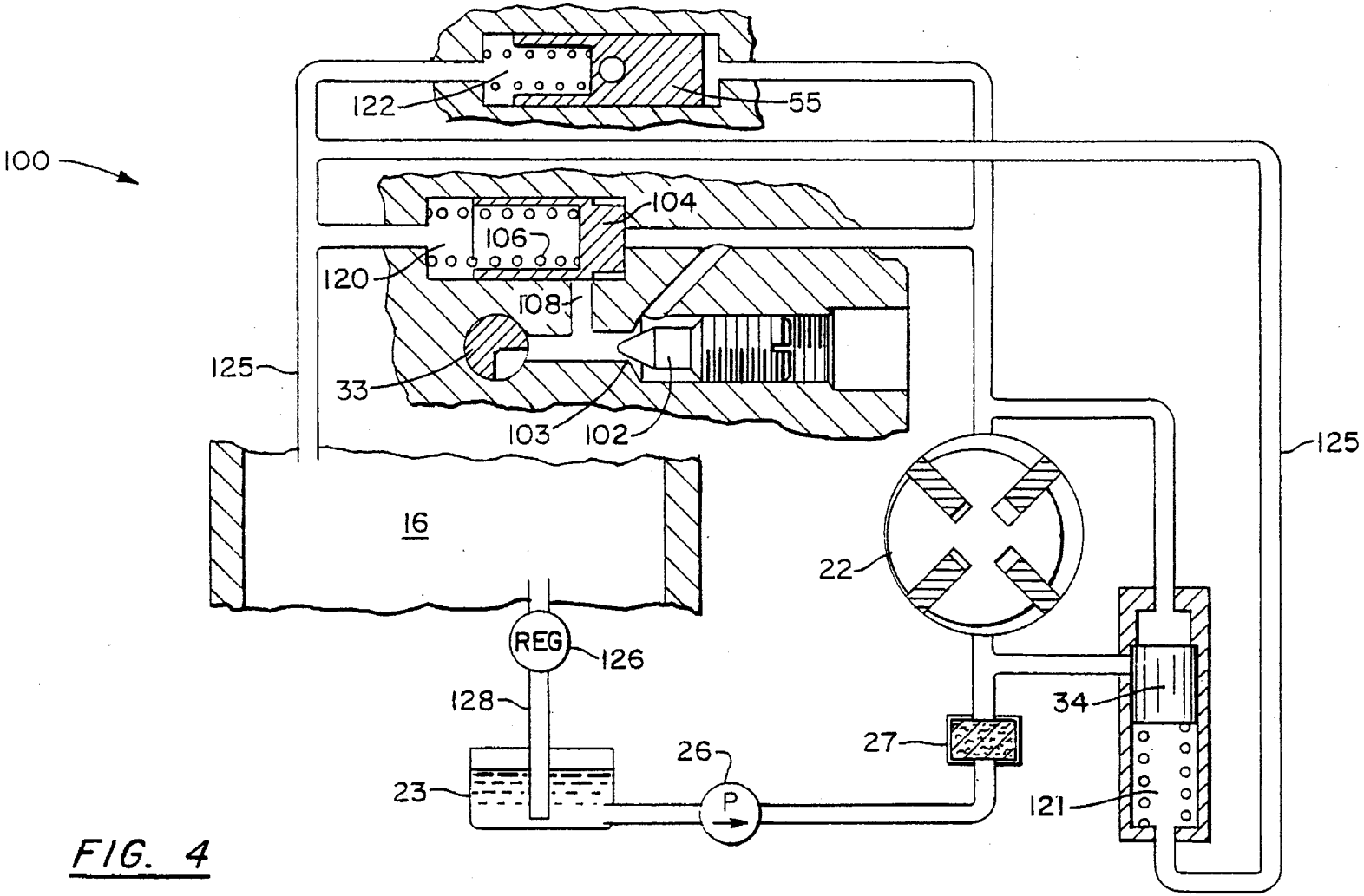
FIG. 4 is a generally diagrammatic view, partly broken away and partly in section, of a fuel system of the fuel injection pump having a modified auxiliary control system incorporating a second embodiment of the present invention.

A modified auxiliary control system 100 incorporating a second embodiment of the present invention is diagrammatically shown in FIG. 4. The modified system 100 also serves as an auxiliary metering system for lowering the upper fuel quantity limit during a certain speed range of the engine. The modified system 100 has a primary flow passage 108 and a low-speed bypass passage 103 which serve the same functions as the primary flow passage 93 and low-speed bypass passage 94. In the modified system 100, a separate needle valve 102 is employed to provide the low-speed bypass passage 103 and a spool type valve member 104 is employed to provide the primary flow passage 108. The rest of the fuel system shown in FIG. 5, including the manner in which the transfer pump 22 and transfer pump regulator piston 34 are connected, is the same as that employed in the embodiment of FIGS. 1–3.

In the modified system 100, the needle valve 102 is manually adjustable to set the size of the low-speed restriction and thereby to set the low threshold speed (e.g., engine speed of 600 RPM) at which the low-speed bypass passage 103 is effective in establishing the upper fuel quantity limit. The spool valve member 104, like the needle valve member 84, is biased by a compression spring 106 to a fully retracted position. With the spool valve member 104 in its fully retracted position, the auxiliary valve is closed (or in the alternative as hereinafter described is slightly open to provide a low-speed passage). The spool valve member 104 is biased in the opening direction by transfer pressure and such that the spool valve member 104 is axially displaced from its fully retracted position when the engine reaches a certain intermediate speed (e.g., engine speed of 1000 RPM) which is higher than the low threshold speed established by the bypass passage 103. If the auxiliary valve is closed when the valve member 104 is in its fully retracted position, at a certain threshold speed at or just above that intermediate speed, the auxiliary valve member 104 opens the primary flow passage 108. Thereafter, the flow restriction provided by the primary flow passage 108 increases in size with the axial displacement of the spool valve member 104 in the opening direction.

The entire end face (and entire transverse area) of the spool valve member 104 is acted on by the transfer pressure. Accordingly, unlike the embodiment of FIGS. 1–3, the axial position of the spool valve member 104 is not affected by the downstream fuel pressure at the metering valve inlet. In some pump applications, during certain operating conditions, the pressure at the metering valve inlet can fluctuate significantly due to the periodic closure of the inlet ports 40. As a result, in the embodiment of FIGS. 1–3, the needle valve 84 may oscillate during a transition speed range into and out of engagement with the valve seat 88. In those pump applications, the modified system 100 is preferably employed.

The primary passage 93 or 108 and low-speed bypass passage 94 or 103 are provided in series with the transfer pump 22, inlet metering valve 33 and pumping chamber 39 preferably between the transfer pump 22 and metering valve 33 and therefore upstream of the inlet metering valve 33. In the alternative, the two passages could be provided downstream of the inlet metering valve 33 if the design of the fuel injection pump facilitated or was made to facilitate such an alternative. Also, in the modified system 100, in lieu of the separate low-speed bypass passage 103, a manually adjustable valve stop (not shown) could be used to manually set the fully retracted position of the spool valve member 104 at which the spool valve member 104 is held open slightly by the stop to establish a low-speed passage having the desired low-speed flow restriction.

In both embodiments 80, 100 of the auxiliary control system, the spring or back pressure chamber 120 of the auxiliary valve piston 84 or 104 is connected to the spring or back pressure chamber 121 of the regulator piston 34. That is best seen in FIG. 4. As also seen in FIG. 4, the back pressure chamber 122 of the timing piston 55 is connected to the back pressure chamber 121 of the regulator piston 34. As further seen in FIG. 4, all three back pressure chambers 120–122 are connected via a low pressure line 125 and low pressure regulator 126 to a low pressure fuel tank return line 128 (e.g., at atmospheric pressure). That connection is achieved by connecting the three back pressure chambers 120–122 to the housing cavity and by employing a conventional housing pressure regulator 126 to maintain a low, constant and stable pressure (e.g., 10 psi) in the housing cavity and in each of the back pressure chambers 120–122. Accordingly, the pressure differential between the transfer pressure and back chamber pressure acting on the auxiliary valve piston 84 or 104 and acting on the timing piston 55 is the same as the pressure differential acting on the regulator piston 34. The transfer pressure is regulated by the pressure differential between the regulated outlet pressure and the back pressure in the chamber 121 and in precise relationship to pump speed. Therefore, the auxiliary valve piston 84 or 104 and the timing piston 55, being axially positioned by the same pressure differential, are axially positioned in precise relationship to pump speed.

In fuel injection pumps of conventional design of the type described, the back pressure chamber 121 of the regulator piston 34 is connected to the transfer pump inlet 28. In those pumps, any pressure variations at the transfer pump inlet, caused for example by variations in the feed pump outlet pressure or by variations in the pressure drop across the line filter 27, will affect the operation of the regulator piston 34. In the disclosed system, a low, constant, stable back pressure (which is different than the transfer pump inlet pressure) is maintained in the back pressure chamber 121 of the regulator piston 34 by the housing pressure regulator 126. Consequently, the transfer pressure will not vary due to variations in the transfer pump inlet pressure.

Referring to FIGS. 1–3, the back pressure chamber 120 of the auxiliary valve piston 84 is connected to the housing cavity via an intermediate annulus 140 surrounding a rotor support sleeve, an inclined passage 142 connecting the back pressure chamber 120 to the intermediate annulus 140 and a second inclined passage 144 (FIG. 2) connecting the intermediate annulus 140 to the housing cavity (i.e., governor chamber 16 which forms part of the housing cavity). The intermediate annulus 140 is also connected to the back pressure chamber 121 of the regulator piston 34 via an outer clearance annulus 146 surrounding the transfer pump 22, a radially extending passage 148 in a transfer pump end plate, an axially extending passage 150 in the body of the internal screen filter 25 and a radial port 152 leading to the back pressure chamber 121. A thin orifice plate 154 is mounted in an enlarged bore at the inner end of the passage 150 to dampen flow in a manner largely insensitive to fuel viscosity.

As will be apparent to persons skilled in the art, various modifications, adaptations and variations of the foregoing specific disclosure can be made without departing from the teachings of the present invention.

I claim:

1. In a fuel injection pump having a pumping chamber, at least one pumping plunger, means for reciprocating the pumping plunger(s) to provide alternating intake and pumping strokes for respectively supplying an intake charge of fuel to the pumping chamber and delivering a charge of fuel from the pumping chamber at high pressure for fuel injection, a transfer pump having an outlet and operable for supplying fuel at a regulated outlet pressure which increases with pump speed, an inlet metering valve with a variable inlet metering passage in series fluid communication with and between the transfer pump outlet and pumping chamber and controllable for supplying a metered quantity of fuel from the transfer pump outlet to the pumping chamber via the inlet metering passage, and an auxiliary control system for limiting the maximum quantity of fuel supplied from the transfer pump outlet to the pumping chamber via the inlet metering passage; the improvement wherein the auxiliary control system comprises an auxiliary valve providing a valved fuel passage in series fluid communication with the transfer pump outlet, inlet metering passage and pumping chamber downstream of the transfer pump outlet and upstream of the pumping chamber; the auxiliary valve having a valve bore, a valve piston axially shiftable in the valve bore, first means biasing the valve piston in one axial direction to a first axial position thereof, and second means biasing the valve piston in the opposite axial direction with a bias which increases with said regulated outlet pressure, said second biasing means being operable to shift the valve piston against said first biasing means so that the axial displacement of the valve piston in said opposite direction from one axial position thereof increases as the pump speed increases above a first threshold speed, the valve piston providing a flow restriction in said valved fuel passage having a size which varies with said axial displacement to establish a maximum fuel quantity limit which varies with pump speed.

2. A fuel injection pump according to claim 1 wherein the auxiliary control system comprises a low-speed bypass passage in parallel with said valved fuel passage and providing a low-speed flow restriction which establishes a maximum fuel quantity limit between a second threshold speed, which is less than said first threshold speed, and said first threshold speed.

3. A fuel injection pump according to claim 2 wherein the auxiliary control system comprises manually adjustable means for setting the low-speed flow restriction.

4. A fuel injection pump according to claim 3 wherein the manually adjustable means is a manually adjustable needle valve member.

5. A fuel injection pump according to claim 1 wherein said valved fuel passage is upstream of the inlet metering valve.

6. A fuel injection pump according to claim 2 wherein said valved fuel passage and said low-speed bypass passage are upstream of the inlet metering valve.

7. A fuel injection pump according to claim 1 wherein said flow restriction in said valved fuel passage has a size which increases with said axial displacement to establish a maximum fuel quantity limit which increases with pump speed.

8. A fuel injection pump according to claim 1 further comprising a transfer pump pressure regulator with a regulator bore, a regulator piston axially shiftable in the regulator bore, the regulator bore providing a first back pressure chamber at one end of the regulator piston, the regulator piston being axially shifted to establish said regulated outlet pressure by the pressure differential between said regulated outlet pressure and the back pressure in said first chamber, wherein the auxiliary valve bore provides a second back pressure chamber at one end of the valve piston and the valve piston is axially shifted in said opposite direction by the pressure differential between said regulated outlet pressure and the back pressure in said second chamber, and means connecting said first and second chambers to equalize the back pressures therein at a constant pressure which is less than said regulated outlet pressure and different than the transfer pump inlet pressure.

9. A fuel injection pump according to claim 8 wherein the fuel injection pump has a housing cavity and a housing pressure regulator for maintaining the pressure in the housing cavity at a constant pressure less than said regulated outlet pressure and wherein said connecting means connects said first and second chambers to the housing cavity to equalize the back pressures in said first and second chambers at the constant pressure maintained by the housing pressure regulator.

10. A fuel injection pump according to claim 1 wherein the valve piston is a spool type valve member and said second biasing means biases the valve piston in said opposite direction by the application of said regulated outlet pressure to a constant effective transverse area of the valve piston.

11. A fuel injection pump according to claim 1 wherein the valve piston is a needle valve member and wherein, with the needle valve member in its said first axial position, said second biasing means biases the valve piston in said opposite direction, in part by the application of said regulated outlet pressure to an effective transverse area of the valve piston less than its total transverse area.

12. A fuel injection pump according to claim 1 wherein the auxiliary valve provides a low-speed passage, at least when the valve piston is in its said first axial position, the low-speed passage having a flow restriction establishing a maximum fuel quantity limit between a second threshold speed, which is less than said first threshold speed, and said first threshold speed.

13. A fuel injection pump having a pumping chamber, at least one pumping plunger, means for reciprocating the pumping plunger(s) to provide alternating intake and pumping strokes for respectively supplying an intake charge of fuel to the pumping chamber and delivering a charge of fuel from the pumping chamber at high pressure for fuel injection, a transfer pump for supplying fuel at a regulated outlet pressure which increases with pump speed, a transfer pump pressure regulator with a regulator bore, a regulator piston axially shiftable in said regulator bore, the regulator bore providing a first back pressure chamber at one end of the regulator piston, the regulator piston being axially shifted to establish said regulated outlet pressure by the pressure differential between said regulated outlet pressure and the back pressure in said first chamber, an inlet metering valve in series with and between the transfer pump and pumping chamber for supplying a metered quantity of fuel from the transfer pump to the pumping chamber, and an auxiliary control system comprising a piston bore, a control piston axially shiftable in said piston bore for performing a certain control function, said piston bore providing a second back pressure chamber at one end of said control piston, and shift means for shifting said control piston in one axial direction from a first position thereof in accordance with the pressure differential between said regulated outlet pressure and the back pressure in said second chamber, and means connecting said first and second chambers to equalize the back pressures in said first and second chambers at a constant pressure which is less than said regulated outlet pressure and different than the transfer pump inlet pressure.

14. A fuel injection pump according to claim 13 wherein the fuel injection pump has a housing cavity and a housing pressure regulator for maintaining the pressure in the housing cavity at a constant pressure less than said regulated outlet pressure and wherein said connecting means connects said first and second chambers to the housing cavity to equalize the back pressures in said first and second chambers at the constant pressure maintained by the housing pressure regulator.

15. A fuel injection pump according to claim 13 wherein said shift means biases the control piston in said one direction by the application of said regulated outlet pressure to a constant effective transverse area of the control piston to shift the control piston so that its axial displacement from one axial position thereof increases as said regulated outlet pressure increases above a first threshold pressure.

16. A fuel injection pump according to claim 13 further comprising a second said auxiliary control system and wherein the connecting means connects the second back pressure chamber of said second auxiliary control system to equalize the back pressure therein with the back pressure in said first back pressure chamber.

* * * * *